US009878254B2

(12) United States Patent
Barrera et al.

(10) Patent No.: US 9,878,254 B2
(45) Date of Patent: Jan. 30, 2018

(54) WAVE CATCHING SHUTDOWN LANE

(71) Applicant: Whitewater West Industries Ltd., Richmond (CA)

(72) Inventors: Claudio J. Barrera, South Surrey (CA); Karl J. Carlson, Surrey (CA); Bruce R. Bradley, Vancouver (CA); Andrey Khomovskiy, New Westminster (CA)

(73) Assignee: Whitewater West Industries Ltd., Richmond, B.C. (CA)

( * ) Notice: Subject to any disclaimer, the term of this patent is extended or adjusted under 35 U.S.C. 154(b) by 0 days.

(21) Appl. No.: 15/351,178

(22) Filed: Nov. 14, 2016

(65) Prior Publication Data

US 2017/0136369 A1 May 18, 2017

Related U.S. Application Data

(60) Provisional application No. 62/254,586, filed on Nov. 12, 2015.

(51) Int. Cl.
*A63G 21/18* (2006.01)
*A63G 31/00* (2006.01)

(52) U.S. Cl.
CPC ..... *A63G 21/18* (2013.01); *A63G 31/007* (2013.01)

(58) Field of Classification Search
CPC ..... A63G 21/00; A63G 21/18; A63G 31/00; A63G 31/007
USPC ..... 472/116–117, 128, 13; 104/69–70
See application file for complete search history.

(56) References Cited

U.S. PATENT DOCUMENTS 4,484,739 A * 11/1984 Kreinbihl ..... A63G 21/18 104/70
5,779,553 A * 7/1998 Langford ..... A63G 21/18 104/73
6,450,891 B1 * 9/2002 Dubeta ..... A63G 21/18 104/69

* cited by examiner

*Primary Examiner* — Kien Nguyen
(74) *Attorney, Agent, or Firm* — Greenberg Traurig LLP

(57) ABSTRACT

An apparatus or method for draining fluid from an amusement attraction while helping prevent substantial portions of fluid from splashing out of the attraction. The apparatus may be an end component for a shutdown lane that has one or more areas or catch basins for flowing the fluid thereon or therethrough. Various sidewalls, hills, ridges, and/or drainage surfaces may be implemented by or on the end component to ideally keep water from splashing outside of the end component and to help maintain rider safety as the rider slides towards the end component. One or more stages of drainage areas or surfaces may be utilized for the end component. The apparatus may be in the form of an end component, a larger portion of an attraction, such as a shutdown lane, or discrete components that may be connected within or to a portion of an attraction.

20 Claims, 5 Drawing Sheets

WAVE CATCHING SHUTDOWN LANE

CROSS REFERENCE TO RELATED APPLICATIONS

This application claims the benefit of U.S. Provisional Patent Application Ser. No. 62/254,586, filed on Nov. 12, 2015, entitled "WAVE CATCHING SHUTDOWN LANE END," which is hereby incorporated by reference in its entirety.

BACKGROUND

1. Field of the Invention

The present invention relates to an apparatus and method for catching waves or water on an amusement attraction. More particularly, the present invention relates to an apparatus and method for catching waves or water at the end (e.g., connected with a shutdown lane) of a waterslide attraction.

2. Description of the Related Art

Waterslides or other amusement attractions frequently use water or other fluids to help move or allow riders to slide along the attraction. This water or fluid may be used as a lubricant to more easily facilitate a sliding movement along the attraction, whether in conjunction with a ride vehicle (e.g., an inflatable raft) or without any ride vehicle (e.g., just the rider themselves). In order to help advance a rider along the attraction and to assist in making the attraction more exciting, riders travel at a quick rate of speed along the attraction. As the rider approaches the end of the attraction, their speed of travel must be slowed so that they can safely exit from the attraction. Typically, this slowing is facilitated either via a pool or other body of water at the end of the attraction into which the riders are deposited or dumped into and/or an elongated "shutdown lane" that acts to provide a distance that the rider slides along as their speed slows. Once the rider has stopped moving at the end of the attraction, the rider may then safely exit the attraction, either through standing up and stepping out of the shutdown lane and/or swimming out of the pool or other body of water.

In order to conserve water and lower operational costs, water from the shutdown lane, pool, and/or other body of water is typically pumped or otherwise transferred to the beginning of the water attraction and used as the previously described lubrication. Thus, in an ideal attraction, water used as lubrication and/or in the shutdown lane or body of water at the end of the attraction is conserved and thus available for reuse. Typically, however, some water is splashed out of the attraction, often when a shutdown lane is used since the sliding motion of the rider sometimes causes water in the shutdown lane to splash up and out of the confines of the shutdown lane. It would thus be desirable to have a more efficient manner to slow a rider down in a shutdown lane that also helps conserve water by retaining as much water as possible within the confines of the attraction for recirculation. Ideally, such an apparatus or method would provide an end component for a shutdown lane that reduces risk of injury to a rider as the rider slides towards the end component while also helping maintain a substantial amount of water from splashing out of the shutdown lane and/or end component due to the rider's sliding motion there-towards.

SUMMARY

The present invention is related to an apparatus and method for capturing fluid at an end of a portion of an amusement attraction. In one embodiment, an apparatus for draining fluid in an amusement attraction may include a first surface, a second surface, disposed adjacent to the first surface, at least a portion of the second surface being porous, a sidewall connected with the first surface and the second surface, and a connecting area disposed between the first surface and the second surface configured to receive fluid that does not flow through the porous portion of the second surface.

In another embodiment, a system for removing fluid from an amusement attraction may include a first surface, and a second surface configured to be located adjacent to the first surface, at least a portion of the second surface being porous, wherein a connecting area is configured to be located between the first surface and the second surface for receiving fluid that does not flow through the porous portion of the first surface or the porous portion of the second surface.

In still another embodiment, a shutdown lane for a water attraction may include an elongated flume for flowing a fluid therealong, a first surface connected within the elongated flume, a second surface connected within the elongated flume and positioned adjacent to the first surface, at least a portion of the second surface being porous, and a lower area disposed between the first surface and the second surface configured to receive at least a portion of the fluid that does not flow through the porous portion of the second surface.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1A:
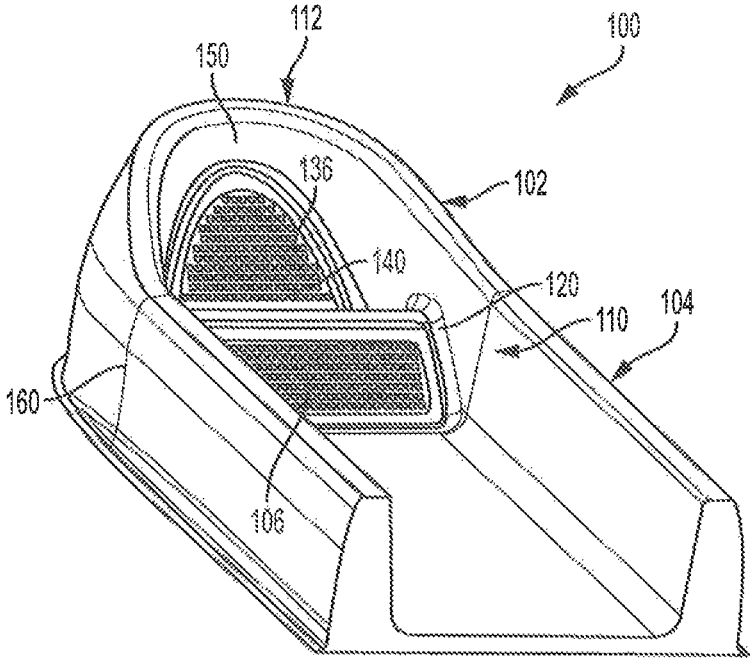
FIG. 1A shows a perspective view of a wave catching shutdown lane end, according to one embodiment of the present invention.

FIG. 1A illustrates a perspective view 100 of a wave catching shutdown lane end 102. The end 102 may be connected to (or integral with) a shutdown lane 104 of a waterslide or other amusement attraction. For example, the waterslide or other amusement attraction may allow a rider to slide along a path from one location (e.g., a rider entrance) to a second location (e.g., a rider exit) of the attraction. The shutdown lane 104 may be provided for the purposes of slowing the rider down after travel upon the attraction to facilitate the rider's exiting from the attraction. Thus, the end 102 of the shutdown lane 104 may aid in conserving water, as discussed in greater detail below, which is flowing along the shutdown lane 104. In an alternative embodiment, the end 102 may be connected and/or integral with components other than a shutdown lane 104.

Figure 3:
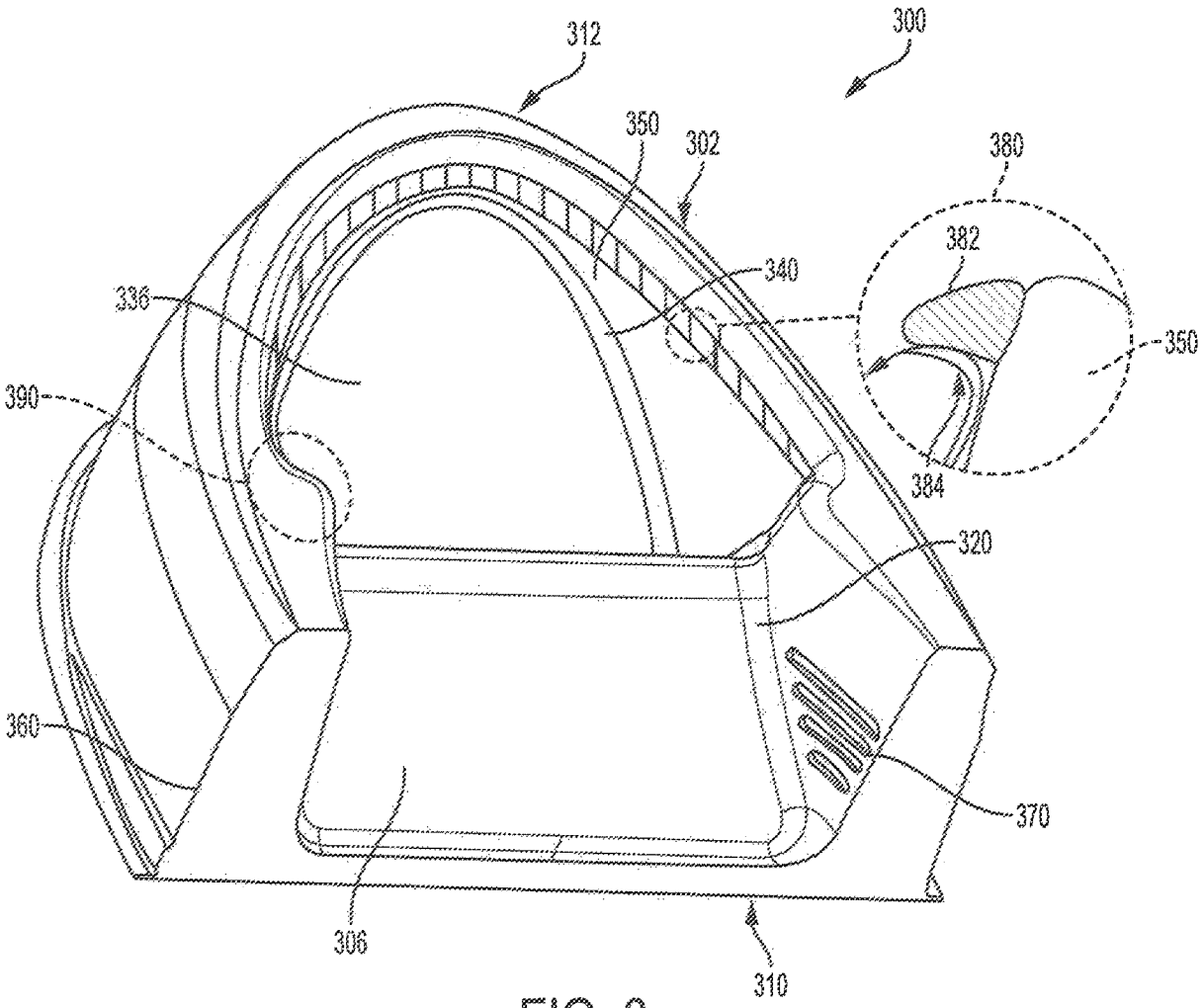
FIG. 3 shows a perspective view of a wave catching shutdown lane end, according to one embodiment of the present invention.

As illustrated, the end 102 may include a first surface 106 disposed at and/or adjacent to a first portion 110 (e.g., a front or forward portion) of the end 102. For example, if water or fluid is flowing along the shutdown lane 104 towards the end 102, the water or fluid would encounter the first surface 106 (e.g., a front surface) initially upon encountering the end 102. The first surface 106 may be porous (e.g., may include a grating) in order to allow all or some of the water or other fluid flowing along the shutdown lane 104 to pass through the first surface 106. Alternative embodiments may use any of a variety of porous materials and/or configurations for fluid pass-through. For example, a part of the first surface 106 may be porous 199 while another part of the first surface may be non porous 198, as illustrated in one configuration in FIG. 1C). In still other embodiments, for example, as illustrated in FIG. 3, the first surface 106 may not be porous such that no fluid may pass through it.

In certain embodiments, the first surface 106 may allow the water or other fluid to be removed from the shutdown lane 104 and transported to a reservoir, channel, pipe, or other chamber or component (e.g., positioned beneath the end 102) that permits the water to be pumped (e.g., using fluid pumps, pressurized components, or other equipment) to another portion of the attraction (e.g., to a top location, such as a rider entrance location). In this fashion, fluid used with the attraction may be all or partially conserved such that all or some of the fluid is re-used or replenished along the attraction. Such operation may save cost in the form of water usage bills, in addition to being more environmentally friendly.

Moreover, such operations may also provide a number of other benefits—may reduce splashing at an end of the attraction, may allow other users or participants in the vicinity of the attraction to be nearer to the end of the attraction without getting wet to allow for better footprint management of the attraction and/or its pathways, may allow for better observation of the attraction by individuals located nearby without undesirably being splashed or otherwise inconvenienced, etc. For example, the water or other fluid may travel through the porous surface or grating of the first surface 106, be directed through a sleeve or other fluid directing element attached with or adjacent to the end 102, and flowed into a sump pit or other retaining area. As previously mentioned, in certain embodiments, the first surface 106 may not be porous (e.g., may be configured to allow water or other fluid to flow thereover instead of passing therethrough) yet the end 102 may still aid in fluid conservation as discussed in greater detail herein.

The first surface 106 may be angled (e.g., a lower portion 107 of the first surface 106 may be disposed at a location in front of an upper portion 108 of the first surface 106). The angle of the first surface 106 may be constant or may vary at different points along the first surface 106. Such a configuration may permit for more efficient flow of water through and/or over the first surface 106, reducing the amount of water or fluid that is splashed, due to abrupt contact with the first surface 106, for example, outside of the shutdown lane 104 and/or end 102. In an alternative embodiment, the first surface 106 may be more horizontal or vertical than the specific embodiment illustrated.

One or more side elements 120 may extend along all or a portion of the first surface 106, for example, to aid in desired water low through or over the first surface 106. The side elements 120 may be disposed on two opposing sides of the first surface 106 and/or may be curved (e.g., convex and/or concave) along some or all of their portions in order to flow water or other fluid along an ideal or desired path. The first surface 106 may be planar and/or may be configured in any of a variety of orientations or configurations in alternative embodiments (e.g., all or a portion may be curved, such as with a convex or concave shape, and/or may include angles or portions that abruptly lie within a different plane from adjacent angles or portions).

The end 102 may include a second surface 136 disposed at and/or adjacent to a second portion 112 (e.g., a rear portion) of the end 102. The second portion 112 may be further from the shutdown lane 104 than the first portion 110 (e.g., located more downstream). Thus, the second surface 136 may be disposed further away from the shutdown lane 104 than the first surface 106 and water flowing from the shutdown lane 104 would encounter the first surface 106 prior to encountering the second surface 136. The second surface 136 may include certain features that are the same as or similar to the first surface 106, previously discussed. The second surface 136 may be parallel or substantially parallel to the first surface 106.

For example, the second surface 136 may be porous (e.g., have a grating) that permits water or other fluid to pass therethrough, the same as or similar to the first surface 106, as previously discussed. In certain embodiments, the second surface 136 may not be porous or may only be partially porous. Likewise, for example, the second surface 136 may be angled, the same as or similar to the first surface 106, as previously discussed. The angle of the second surface 136 may be constant or may vary at different points along the second surface 136. The second surface 136 may be angled according to a same angle with respect to the horizontal as the first surface 106, or may be angled at a different angle (e.g., more or less steep) as the first surface 106. The second surface 136 may include side elements 140 the same as or similar to those side elements 120 previously discussed with respect to the first surface 106 (e.g., one or more side elements 140 may be concave or convex shaped, may surround all or some of a perimeter of the second surface 136, etc).

Figure 1B:
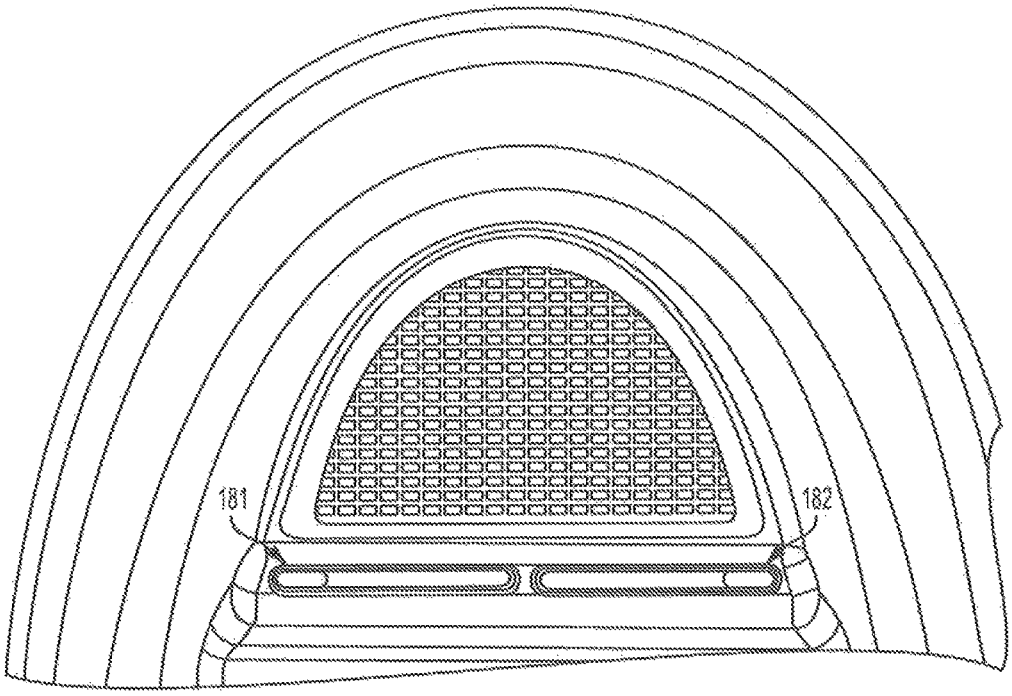
FIG. 1B shows a front view of a portion of a wave catching shutdown lane end, according to one embodiment of the present invention.
Figure 1C:
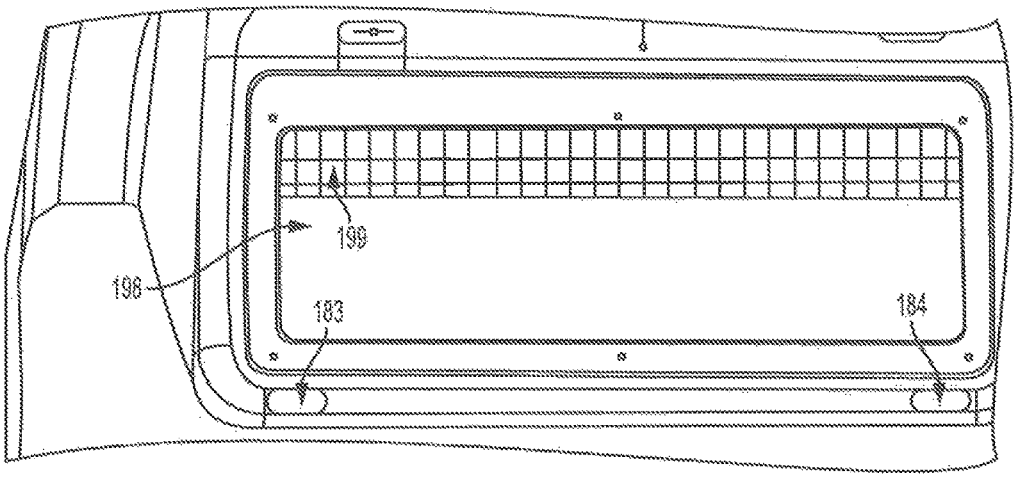
FIG. 1C shows a front view of a portion of a wave catching shutdown lane end, according to one embodiment of the present invention.

The second surface 136 may be shaped and/or configured differently than the first surface 106, for example, as illustrated. The second surface 136 may have a more parabolic or curved configuration and/or may extend to a higher elevation than the first surface 106. A taller second surface 136 when compared to the first surface 106 may aid in containing water or other fluid within the end 102 or attraction. In such an embodiment, some or all of the water or other fluid that flows over the first surface 106, as opposed to flowing through the first surface 106, may encounter the second surface 136 and flow therethrough or thereon. The second surface 136 may similarly allow water or other fluid to be removed from the shutdown lane 104 by providing it to a reservoir, channel, pipe, or other chamber or component (e.g., the same or similar to previously descriptions for the first surface 106) that permits the water or other fluid to be pumped or otherwise provided to another portion of the attraction, such as a rider entrance location. As illustrated in FIGS. 1B and/or 1C, one or more slots (181, 182, 183, 184) or other openings, that may or may not be selectively operable or closeable, may be provided in or adjacent to the first surface 106 and/or the second surface 136 (e.g., in the configurations shown in FIGS. 1B and/or 1C), for example, to allow for drainage of fluid that does not rise to the level of the first surface 106 and/or the second surface 136.

A sidewall 150, that may be made up of one or multiple components, connects with the first surface 106 and/or the second surface 136, for example, via the side elements 120 and/or 140. The sidewall 150 may be configured to extend to a higher elevation than both the first surface 106 and/or the second surface 136. For example, the sidewall 150 may aid in preventing water or other fluid that undesirably splashes or flows to areas outside of the boundaries of the first surface 106 and/or second surface 136 from exiting the end 102. Thus, water or other fluid that encounters the sidewall 150 may be directed back towards either the first surface 116 and/or the second surface 136 so that it may flow therethrough and be recirculated to another portion of the attraction, as previously discussed. Although the embodiment illustrated in FIG. 1A shows that the sidewall 150 extends adjacent to both the first surface 106 and the second surface 136 via a curved configuration, any of a variety of alternative shapes, dimensions, configurations, elevations, or the like may be utilized in an alternative embodiment. In certain embodiments, no sidewall 150 may be needed. For example, in one embodiment, the sidewall 150 may be curl inward along a top portion of its perimeter to further aid in keeping water from exiting the end 120.

The end 102 may be configured as a removable component or set of components that is configured to attach or connect along a seam 160 to the shutdown lane 104. In one embodiment, a fluid control component (e.g., a weir) embedded in or connected with either the first surface 106, the second surface 136, or both may be used for setting the operating water depth of the shutdown lane 104. In certain embodiments, the end 102 may be configured to similarly connect to other portions of a waterslide or other amusement attraction different from a shutdown lane 104. For example, such a connection may allow for existing attractions to be retrofitted with the end 102. This may allow existing attractions to benefit from the features of the present invention in addition to newly constructed attractions utilizing the end 102.

As discussed, FIG. 1A illustrates an end 102 that utilizes two surfaces (106, 136) for engaging with water or other fluid of an amusement attraction. Such a two surface or dual-stage arrangement for water conservation may be modified in alternative embodiments to provide greater or fewer surfaces or stages. For example, in one embodiment, three surfaces (i.e., a three-stage arrangement) may be utilized, for example, where each of the three surfaces is disposed in front of another for flowing water or other fluid therethrough or thereover. In another embodiment, only one surface (i.e., a one-stage arrangement) may be utilized, where only a single surface is utilized for flowing water or other fluid therethrough or thereover. In certain embodiments, it may be desirable to maintain as wide of a cross-sectional width for the end 102 for as long as possible (e.g., maintain a width that is the same as or similar to the cross-sectional wide of the shutdown lane 104) in order to efficiently and/or safely evacuate water or other fluid from the shutdown lane 104.

In still another embodiment, a cover component may extend over all or some of the second surface 136 and/or the first surface 106 such that the end 102 forms an at least partially enclosed end component. Such an at least partially enclosed end component may provide for increased capture of water that could otherwise splash out of the end 102. Such a cover component may be manufactured all or partially of a soft material (e.g., polyurethane) and connected with one or more components of the end 102 (e.g., via glue or other adhesive and/or by mechanical means such as screws, bolts, etc.) such that any impact with the cover component by a rider would pose less risk of injury. In an alternative embodiment, any of a variety of materials may be used. Any of the previous described features may be included or used for any of the variety of possible embodiments. Elevations and/or shapes and/or other configurations of any of the surfaces used may be varied for a particular embodiment.

Figure 2:
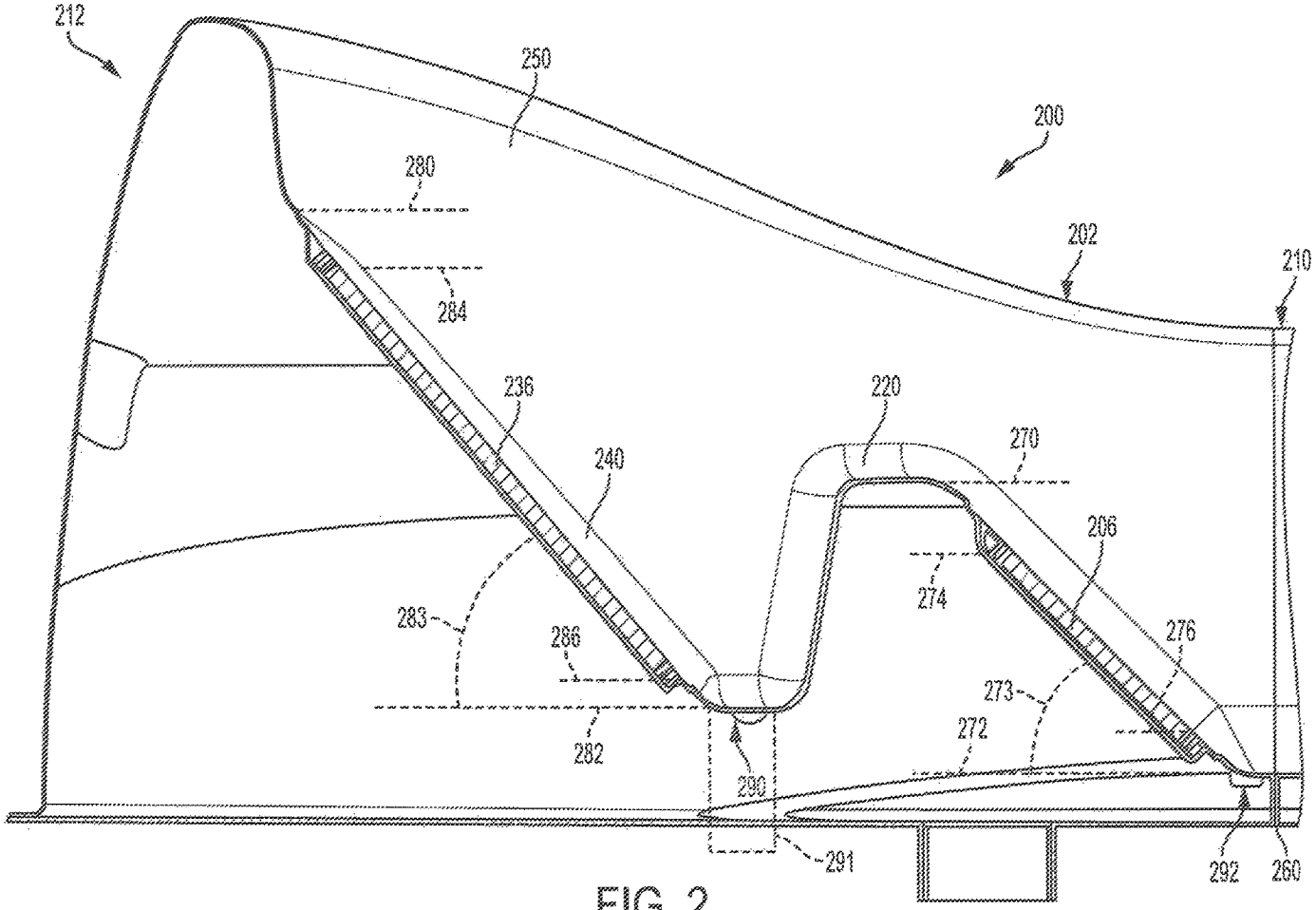
FIG. 2 shows a side view of a wave catching shutdown lane end, according to one embodiment of the present invention.

FIG. 2 shows a side view 200 of a wave catching shutdown lane end 202. Certain features of the end 202 may be the same as or similar to those previously described. For example, the end 202 may be connected or configured to be connected to a shutdown lane or other flume or portion of a waterslide or other amusement attraction. Similar to the discussion for FIG. 1A, the end 202 may include a first surface 206 disposed at and/or adjacent to a first portion 210 (e.g., a front portion) of the end 202. All or some of the first surface 206 may be porous (e.g., may be a grating) in order to allow all or some of the water or other fluid flowing to the end 202 to pass through the first surface 206. Alternative embodiments may use any of a variety of porous materials and/or configurations for fluid pass-through. In certain embodiments, the first surface 206 may not be porous or configured to allow water or other fluid to pass therethrough.

The first surface 206 may be angled (e.g., a lower portion of the first surface 206 may be disposed at a location in front of an upper portion of the first surface 206). Such a configuration may permit for more efficient flow of water through and/or over the first surface 206. The first surface 206 may extend from an upper elevation 270 to a lower elevation 272 and form an angle 273 with respect to the horizontal. This angle may be less than 90 degrees in certain embodiments. A porous portion of the first surface 206 may be disposed upon only a portion of the first surface 206, for example, extending from an upper elevation 274 to a lower elevation 276. In varying embodiments, this porous portion may cover greater (e.g., the entire first surface 206) or less than the entire first surface 206, for example, as is specifically illustrated by FIG. 4 in one embodiment.

One or more side elements 220 may extend along all or a portion of the first surface 206, for example, to aid in desired water flow through or over the first surface 206, the same as or similar to previous discussions. The first surface 206 may be planar and/or may be configured in any of a variety of orientations or configurations in alternative embodiments (e.g., all or a portion may be curved, such as with a convex or concave shape, and/or may include angles or portions that abruptly lie within a different plane from adjacent angles or portions).

The first surface 206 may rise to form a hill having the upper elevation 270. Some or all of the water or other fluid encountering the porous portion of the first surface 206 will pass through the porous portion of the first surface. Any remaining water or other fluid may ideally be flowed over the hill towards a second surface 236 of the end 202 that is disposed at and/or is adjacent to a second portion 212 (e.g., a rear or downstream portion) of the end 202. The second surface 236 may include certain features that are the same as or similar to the first surface 206, previously discussed. For example, the second surface 236 may have a porous portion (e.g., have a grating) that permits water or other fluid to pass therethrough, the same as or similar to the first surface 206.

The second surface 236 may be angled (e.g., extending to a higher elevation when compared to the first surface 206), the same as or similar to previously discussions. In one embodiment, for example as illustrated in FIG. 2, a lower portion of the second surface 236 may be disposed at a location in front of an upper portion of the second surface 236. Such a configuration may permit for more efficient flow of water through and/or over the second surface 236 (e.g., such an angled surface may allow for a greater surface area for drainage). The second surface 236 may extend from an upper elevation 280 to a lower elevation 282 and form an angle 283 with respect to the horizontal. The angle 283 may be the same as or different from the angle 273 in various embodiments. This angle 283 may be less than 90 degrees in certain embodiments. A porous portion of the second surface 236 may be disposed upon only a portion of the second surface 236, for example, extending from an upper elevation 284 to a lower elevation 286. In varying embodiments, this porous portion may cover greater (e.g., the entire second surface 236) or less than the entire second surface 236 as is specifically illustrated by FIG. 2.

One or more side elements 240 may extend along all or a portion of the second surface 236, for example, to aid in desired water flow through or over the second surface 236, the same as or similar to previous discussions. The second surface 236 may be planar and/or may be configured in any of a variety of orientations or configurations in alternative embodiments (e.g., all or a portion may be curved, such as with a convex or concave shape, and/or may include angles or portions that abruptly lie within a different plane from adjacent angles or portions).

The second surface 236 may rise to a higher upper elevation 280 when compared to the upper elevation 270 of the first surface 206. Some or all of the water or other fluid encountering the porous portion of the second surface 236 may pass through the porous portion of the second surface 236. Any remaining water or other fluid may ideally be flowed (e.g., by encountering a sidewall 250 and/or by flowing downward due to or over the second surface 236) to a lower or connecting area 290 (e.g., a catch basin) disposed, for example, at the lower elevation 282. The lower elevation 282 may be higher or lower (e.g., with respect to other elements of the end 202 in alternative embodiments). Moreover, although the lower elevation 282 is illustrated as horizontal and planar in FIG. 2, other elevations and/or shapes for the lower or connecting area 290, including sloped, curves, angled, etc. may be used in alternative embodiments. The lower or connecting area 290 may have a length 291 that may be any of a variety of length (e.g., shorter or longer than may be specifically illustrated in FIG. 2) in alternative embodiments. In certain embodiments, the length 291 may be adjustable (e.g., via telescoping or sliding surfaces, addition of separate surfaces to extend the overall length, etc.).

The lower or connecting area 290 may be at any of a variety of elevations or excluded entirely from the end 202. In certain embodiments, further drainage of water or other fluid may occur at the lower or connecting area 290 (e.g., via a porous surface in or near the lower or connecting area 290, the same as or similar to those previously discussed). Other embodiments may collect a pool of water or other fluid at the lower or connecting area 290. A similar lower or connecting area 292 may be disposed at the lower elevation 272, as illustrated, or at a variety of other elevations or excluded entirely in alternative embodiments.

The second surface 236 may be shaped and/or configured differently than the first surface 206, for example, as illustrated. The second surface 236 may be larger in surface area, have a more parabolic or curved configuration and/or may extend to a higher elevation than the first surface 206. In such an embodiment, some of all water or other fluid that flows over the first surface 206, which does not flow through the first surface 206, may encounter the second surface 236.

The sidewall 250 connects with the first surface 206 and/or the second surface 236, for example, via the side elements 220 and/or 240. The sidewall 250 may be configured to extend to a higher elevation than both the first surface 206 and/or the second surface 236. For example, the sidewall 250 may aid in preventing water or other fluid that undesirably splashes or flows to areas outside of the boundaries of the first surface 206 and/or second surface 236 from exiting the end 202. Thus, water or other fluid that encounters the sidewall 250 may be directed back towards the first surface 206 and/or the second surface 236 and/or another area (e.g., lower or connecting area 290 and/or lower or connecting area 292) so that it may flow therethrough and be recirculated to another portion of the attraction, as previously discussed. Although the embodiment illustrated in FIG. 2 shows that the sidewall 250 extends adjacent to both the first surface 206 and the second surface 236 via a curved configuration, any of a variety of alternative shapes, dimensions, configurations, elevations, or the like may be utilized in an alternative embodiment. For example, in certain embodiments, the sidewall 250 may be configured to extend over the top such as to enclose all or a portion of the end 202. In certain embodiments, no sidewall 250 may be needed.

The same or similar to previous discussions, the end 202 may be configured as a removable component or set of components that is configured to attach or connect along a seam 260 to another portion of a waterslide or other attraction (e.g., the seam 260 may comprise the first portion 210 (e.g., the front portion) of the end 202. Such a connection may allow for existing attractions to be retrofitted with the end 202. This may allow existing attractions to benefit from the features of the present invention in addition to newly constructed attractions utilizing the end 202.

As discussed, FIG. 2 illustrates the end 202 that utilizes two surfaces (206, 236) for engaging with water or other fluid of an amusement attraction. Such a two surface or dual-stage arrangement for water conservation may be modified in alternative embodiments to provide greater or fewer surfaces and/or stages. For example, in one embodiment, three surfaces a three-stage arrangement) may be utilized, for example, where each of the three surfaces is disposed in front of one another for flowing water or other fluid therethrough or thereover. In another embodiment, only one surface (i.e., a one-stage arrangement) may be utilized, where only a single surface is utilized for flowing water or other fluid therethrough or thereover. In still another embodiment, a cover component (e.g., the same as or separate from the sidewall 250) may extend over all or some of the second surface 236 and/or the first surface 206 such that the end 202 forms an at least partially enclosed end component. Such an at least partially enclosed end component may provide for increased capture of water that could otherwise splash out of the end 202. Any of the previous described features may be included or used for any of the variety of possible embodiments. Elevations and/or shapes and/or other configurations of any of the surfaces used may be varied for a particular embodiment.

FIG. 3 shows a perspective view 300 of a wave catching shutdown lane end 302. Certain features of the end 302 may be the same as or similar to those previously described. For example, the end 302 may be connected or configured to be connected to a shutdown lane or other flume or portion of a waterslide or other amusement attraction. The end 302 may include a first surface 306 disposed at and/or adjacent to a first portion 310 (e.g., a front or upstream portion) of the end 302. As illustrated, the first surface 306 may be configured such that water or other fluid flows over all or a portion of it along an upward trajectory (e.g., due to an upward sloping configuration of the first surface 306, the same as or similar to previous discussions). Although not illustrated in FIG. 3, in an alternative embodiment, the first surface 306 may be entirely or partially porous such that water or other fluid is permitted to flow therethrough, for example, as previously discussed. Moreover, in an alternative embodiment, varying configurations, positions, and/or orientations of the first surface 306 may be utilized (e.g., downwardly angled or sloped, vertical, horizontal, curved, etc.). Side elements 320 may be disposed along sides (e.g., opposite sides) of the first surface 306 and provide a connection and/or an intermediate surface between the first surface 306 and a sidewall 350. The sidewall 350 may be made up of one component or a plurality of separate components connected with one another.

As shown, the first surface 306 rises to form a hill. Some or all of the water or other fluid encountering the first surface 306 may flow over the hill towards a second surface 336 of the end 302 that is disposed at and/or adjacent to a second portion 312 (e.g., a rear portion) of the end 302. The second surface 336 may include certain features that are the same as or similar to the first surface 306, previously discussed. For example, the second surface 336 may or may not be angled and/or entirely or partially porous for permitting water or other fluid to pass therethrough, the same as or similar as previously described. In certain embodiments, drainage areas (e.g., gratings) may be positioned on any of the first and/or second surfaces (306, 336) and/or at a lower area(s) adjacent to the bottom of the angled first surface 306 and/or second surface 336 such that water or other fluid that encounters the first and/or second surfaces (306, 336) flows down the first and/or second surfaces (306, 336) and subsequently drains through the lower areas. As previously discussed, this water or other fluid may then be recirculated to other portions of the amusement attraction.

Similar to the side elements 320, one or more side elements 340 may extend along all or a portion of the second surface 336, for example, to aid in desired water flow through or over the second surface 336, the same as or similar to previous discussions. The second surface 336 may be planar and/or may be configured in any of a variety of orientations or configurations in alternative embodiments (e.g., all or a portion may be curved, such as with a convex or concave shape, and/or may include angles or portions that abruptly lie within a different plane from adjacent angles or portions). As illustrated, the second surface 336 may rise to a higher elevation when compared to that of the first surface 306.

The second surface 336 may be shaped and/or configured differently than the first surface 306, for example, as illustrated. The second surface 336 may be larger in surface area, have a more parabolic or curved configuration and/or may extend to a higher elevation than the first surface 306. The sidewall 350 connects with the first surface 306 and/or the second surface 336, for example, via the side elements 320 and/or 340. The sidewall 350 may be configured to extend to a higher elevation than both the first surface 306 and/or the second surface 336. For example, the sidewall 350 may aid in preventing water or other fluid that undesirably splashes or flows to areas outside of the boundaries of the first surface 306 and/or second surface 336 from exiting the end 302.

Thus, water or other fluid that encounters the sidewall 350 may be directed back towards either the first surface 306 and/or the second surface 336 and/or another area (e.g., the lower area(s) adjacent to the first and/or second surfaces (306, 336)) so that it may be recirculated to another portion of the attraction, as previously discussed. Although the embodiment illustrated in FIG. 3 shows that the sidewall 350 extends adjacent to both the first surface 306 and the second surface 336 via a curved configuration, any of a variety of alternative shapes, dimensions, configurations, elevations, or the like may be utilized in an alternative embodiment. For example, in certain embodiments, the sidewall 350 may be configured to extend over the top such as to enclose all or a portion of the end 302. In certain embodiments, no sidewall 350 may be needed.

FIG. 3 also illustrates a lip 382 that is connected with the sidewall 350 for providing an additional guard against water or other fluid from exiting the confines of the end 302. The lip 382 may a distinct component (e.g., made of a same material or a different material from the sidewall 350) that is affixed to the sidewall 350 or may be integral with the sidewall 350 (e.g., the sidewall 350 itself may be shaped so as to form such a lip). For example, as shown in the zoomed-in portion 380, water or other fluid 384 that is flowed or splashed against the sidewall 350 may encounter the lip 382 to aid in directing the water or other fluid 382 to stay within the end 302 (e.g., directing it back down towards the first and/or second surfaces (306, 336)). Although illustrated in a particular configuration surrounding a part of the second surface 336, in an alternative embodiment, the lip may be configured differently (e.g., in different shapes, curvatures, lengths, placement, etc.) and around and/or adjacent to other portions of the end 302 (e.g., the first surface 306).

For example, the lip 382 may be configured to substantially extend over the entire second surface 336 and/or first surface 306 in an alternative embodiment. The lip 382 may be made out of a variety of materials (e.g., soft or resilient materials, such as polyurethane) that is fastened (e.g., adhered, such as with glue) to one or more components of the end 302. In one embodiment, one or more of the components of the end 302 may be manufactured of fiberglass. One or more slots 370 may be employed along the sidewall 350 and/or other portions or surfaces of the end 302 to encourage fluid flow along a desired path. In varying embodiments, the one or more slots 370 may be depressions or raised edges and/or may be shaped or positioned in a variety of areas.

The same or similar to previous discussions, the end 302 may be configured as a removable component or set of components that is configured to attach or connect along a seam 360 to another portion of a waterslide or other attraction (e.g., the seam 360 may comprise the first portion 310

(e.g., the front portion) of the end 302. Such a connection may allow for existing attractions to be retrofitted with the end 302. This may allow existing attractions to benefit from the features of the present invention in addition to newly constructed attractions utilizing the end 302.

The end 302 may utilize greater or fewer surfaces and/or greater or fewer of the features described and explicitly illustrated in an alternative embodiment. For example, greater or fewer surfaces than just the first and second surfaces (306, 336) may be employed for water flow and/or drainage in an alternative embodiment. A curved portion 390 of the end 302 illustrates an inward curve of the sidewall 350 adjacent to the top of the angled first surface 306. In an alternative embodiment (for example, as seen in FIG. 2) this portion may not be curved such that the sidewall 350 does not veer inward at the top of the angled first surface 306. A sidewall that is substantially perpendicular to a plane containing the first surface at a position adjacent to the top of the first surface may provide a desirable fluid flow in certain embodiments.

Figure 4:
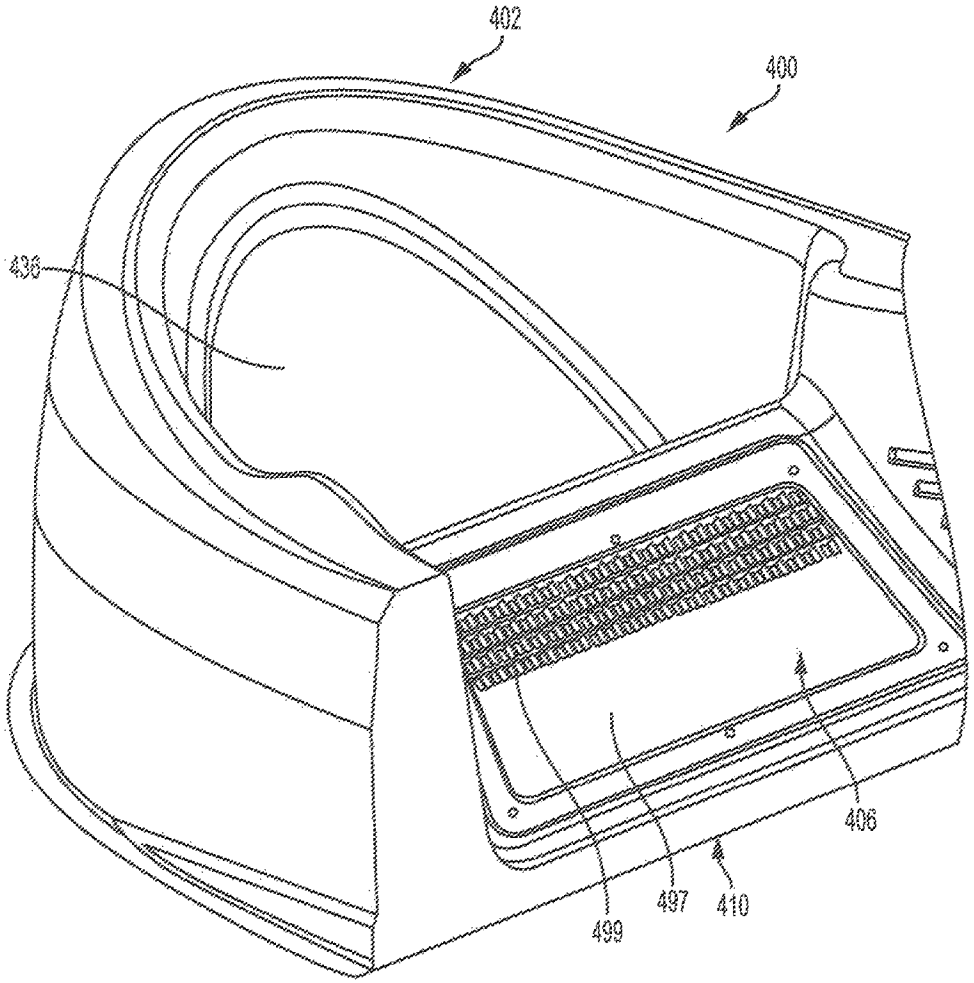
FIG. 4 shows a perspective view of a wave catching shutdown lane end, according to one embodiment of the present invention.

FIG. 4 shows a perspective view 400 of a wave catching shutdown lane end 402. Certain features of the end 402 may be the same as or similar to those previously described. For example, the end 402 may be connected or configured to be connected to a shutdown lane or other flume or portion of a waterslide or other amusement attraction. The end 402 may include a first surface 406 disposed at and/or adjacent to a first portion 410 (e.g., a front or upstream portion) of the end 402. As illustrated, the first surface 406 may be configured such that water or other fluid flows over all or a portion of it along an upward trajectory (e.g., due to an upward sloping configuration of the first surface 406, the same as or similar to previous discussions).

FIG. 4 illustrates that the first surface 406 may include a porous portion or grate 499 such that water or other fluid is permitted to flow therethrough, for example, as previously discussed. A weir plate 497 or other component may be connected with the porous portion or grate 499 (e.g., in front of and/or behind the porous portion or grate 499) and may, in certain embodiments, be used to manage the amount or height of fluid or water in the end 402 or connected shutdown lane. For example, the weir plate 497 may be larger and/or extend higher in elevation with respect to the porous portion or grate 499 in order to allow for a higher elevation of fluid to flow in the shutdown lane or end 402 before it is drained via the porous portion or grate 499. In certain embodiments, the weir plate 497 may be integral with the porous portion 499 such that the porous portion 499 and a non-porous portion form a part of one plate that makes up the first surface 406.

Other aspects of the end 402 may incorporate the same or similar features to those previously discussed. For example, in the exemplary embodiment shown in FIG. 4, a second surface 436 is shown without any porous portions visible, but may be configured to drain water from the end 402 via slots or openings that are obscured from view in FIG. 4 by the first surface 406. In an alternative embodiment, varying configurations, positions, and/or orientations of the first surface 406 and/or the second surface 436 may be utilized (e.g., downwardly angled or sloped, vertical, horizontal, curved, etc.).

Any of the embodiments previously discussed may be modified to include greater or fewer features than those specifically illustrated in their respective figures and/or modified for connection in or with various water or other amusement attractions. For example, as previously discussed, certain embodiments of the invention may be in the form of an end piece, component, or apparatus that is configured to connect to a portion (e.g., a shutdown lane) of an amusement attraction. This amusement attraction may be an existing attraction that is being retrofitted with this end piece, component or apparatus as a new component or in replacement of another component that is being removed from the attraction.

Certain other embodiments of the invention may instead be in the form of an entire portion of the ride (e.g., an entire shutdown lane portion) rather than just an end component for the amusement attraction. Similar to the above, this amusement attraction may be an existing attraction that is being retrofitted with this portion or in replacement of another portion that is being removed from the attraction (e.g., replacing the entire existing shutdown lane with a new shutdown lane containing certain features described herein). Still other certain embodiments of the invention may be in the form of modular and/or discrete components that can be connected with a portion of an amusement attraction (e.g., components, surfaces, etc.) that may be connected with an end piece, shutdown lane, and/or other portion of an amusement attraction in order to include certain of the features described herein. For example, instead of providing an entire end piece or shutdown lane for an amusement attraction, certain embodiments of the invention may include surfaces (e.g., first and second surfaces) that are connected within or to an end piece or shutdown lane so as to embody the features of the invention described herein. Like the above, the end piece, shutdown lane, and/or other portion of an amusement attraction may be for an existing attraction that is being retrofitted with these one or more new components. Alternatively, rather than refurbishment of any attractions as discussed above, certain embodiments may be provided for new water or other amusement attractions.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. An apparatus for draining fluid in an amusement attraction, comprising:

a first surface configured to slow at least some fluid flowing on the amusement attraction;

a second surface disposed adjacent to the first surface, at least a portion of the second surface being porous such that at least some of the fluid slowed by the first surface is flowed through the porous portion of the second surface;

a sidewall connected with the first surface and the second surface; and a connecting area disposed between the first surface and the second surface, the connecting area configured to receive fluid that is slowed by the first surface but does not flow through the porous portion of the second surface.

2. The apparatus of claim 1 further comprising a shutdown lane connected with the sidewall.

3. The apparatus of claim 1 wherein the sidewall is made of fiberglass.

4. The apparatus of claim 1 wherein the first surface is configured to be positioned upstream of the second surface when connected with the amusement attraction.

5. The apparatus of claim 1 wherein the second surface extends to an elevation higher than the first surface.

6. The apparatus of claim 1 wherein the first surface has a first slope with a first angle less than 90 degrees with respect to the horizontal.

7. The apparatus of claim 6 wherein the second surface has a second slope with a second angle less than 90 degrees with respect to the horizontal.

8. The apparatus of claim 7 wherein the first angle equals the second angle.

9. The apparatus of claim 1 further comprising a lip connected with the sidewall for aiding in containing fluid within the sidewall.

10. The apparatus of claim 9 wherein the lip is made of polyurethane.

11. The apparatus of claim 1 wherein the fluid is water.

12. The apparatus of claim 1 wherein at least a portion of the first surface is porous.

13. The apparatus of claim 12 further comprising a weir plate adjacent to the at least the portion of the first surface that is porous.

14. A system for removing fluid from an amusement attraction, comprising:

a first surface for removing at least some fluid at an end of the amusement attraction, at least a portion of the first surface being porous such that the at least some fluid is flowed through the porous portion of the first surface; and a second surface located adjacent to the first surface, at least a portion of the second surface being porous such that at least some of the fluid of the amusement attraction that is not flowed through the porous portion of the first surface is flowed through the porous portion of the second surface, wherein a connecting area is configured to be located between the first surface and the second surface for receiving fluid that does not flow through the porous portion of the first surface or the porous portion of the second surface.

15. The system of claim 14 wherein the first surface has an upper elevation, and the second surface has an upper elevation that is higher than the upper elevation of the first surface.

16. The system of claim 14 further comprising an adjustable weir adjacent to the at least a portion of the first surface that is porous.

17. A shutdown lane for a water attraction, comprising:

an elongated flume disposed at an end of the water attraction for slowing fluid from the water attraction;

a first surface connected within the elongated flume;

a second surface connected within the elongated flume and positioned adjacent to the first surface, at least a portion of the second surface being porous; and a lower area disposed between the first surface and the second surface, the lower area configured to receive at least a portion of the fluid after the portion of the fluid flows over the first surface but does not flow through the porous portion of the second surface.

18. The shutdown lane of claim 17 where at least a portion of the first surface is porous.

19. The shutdown lane of claim 17 further comprising a sidewall connected between the first surface and the second surface.

20. The shutdown lane of claim 17 wherein the second surface extends to an elevation higher than the first surface.

* * * * *